US007128533B2

(12) United States Patent
Liang

(10) Patent No.: US 7,128,533 B2
(45) Date of Patent: Oct. 31, 2006

(54) VORTEX COOLING SYSTEM FOR A TURBINE BLADE

(75) Inventor: George Liang, Palm City, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 108 days.

(21) Appl. No.: 10/938,709

(22) Filed: Sep. 10, 2004

(65) Prior Publication Data

US 2006/0056967 A1 Mar. 16, 2006

(51) Int. Cl.
*F01D 5/18* (2006.01)

(52) U.S. Cl. ..... 416/97 R

(58) Field of Classification Search ..... 416/97 R, 416/92, 96 R

See application file for complete search history.

(56) References Cited

U.S. PATENT DOCUMENTS 3,111,302 A 11/1963 Bowmer
4,293,275 A 10/1981 Kobayashi et al.
5,538,394 A * 7/1996 Inomata et al. ..... 416/97 R
5,695,322 A * 12/1997 Jacobson et al. ..... 416/97 R
5,779,438 A 7/1998 Wilfert
6,033,181 A * 3/2000 Endres et al. ..... 416/97 R
6,227,804 B1 5/2001 Koga et al.
6,331,098 B1 12/2001 Lee
6,431,832 B1 8/2002 Glezer et al.
6,547,525 B1 4/2003 Haehnle et al.
6,609,884 B1 8/2003 Harvey
6,616,405 B1 9/2003 Torii et al.
2002/0106275 A1* 8/2002 Harvey ..... 415/115

* cited by examiner

*Primary Examiner*—Richard A. Edgar

(57) ABSTRACT

A turbine blade for a turbine engine having an internal cooling system formed from a plurality of cooling chambers extending radially in the blade and configured to create vortices within the chambers. In at least one embodiment, the cooling system may be formed from leading edge cooling chambers, trailing edge cooling chambers, suction side mid-chord cooling chambers, and pressure side mid-chord cooling chambers that are configured to receive cooling fluids from supply channels in a root of the blade and to create vortices in the cooling chambers. The vortices of cooling fluids increase heat removal from the turbine blade. The cooling fluids may be exhausted from the turbine blade through film cooling orifices.

15 Claims, 2 Drawing Sheets

VORTEX COOLING SYSTEM FOR A TURBINE BLADE

FIELD OF THE INVENTION

This invention is directed generally to turbine blades, and more particularly to hollow turbine blades having internal cooling channels for passing cooling fluids, such as air, to cool the blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades, as shown in FIG. 1, are formed from a root portion and a platform at one end and an elongated portion forming a blade that extends outwardly from the platform. The blade is ordinarily composed of a tip opposite the root section, a leading edge, and a trailing edge. The inner aspects of most turbine blades typically contain an intricate maze of cooling channels forming a cooling system. The cooling channels in the blades receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade.

Conventional turbine blades have many different designs of internal cooling systems. Many of the cooling systems include channels for passing cooling fluids through a plurality of cooling channels before exhausting the fluids through film cooling holes. While many of these conventional systems have operated successfully, the cooling demands of turbine engines produced today have increased and outgrown the cooling capacities of these conventional systems. Thus, an internal cooling system having increased cooling capabilities is needed.

SUMMARY OF THE INVENTION

This invention relates to a turbine blade capable of being used in turbine engines and having a turbine blade cooling system for dissipating heat from the turbine blade. The cooling system is formed from a plurality of cooling chambers in internal aspects of a turbine blade that extend radially from the platform of the turbine blade and are configured to create vortices of cooling fluids as the cooling fluids flow through the cooling chambers. The rapidly spinning vortices in the cooling chambers increase heat transfer and heat removal relative to conventional designs.

The turbine blade may be formed from a generally elongated blade having a leading edge, a trailing edge, a tip at a first end, a root coupled to the blade at an end generally opposite the first end for supporting the blade and for coupling the blade to a disc, at least one cavity forming a cooling system in the blade, and at least one outer wall defining the cavity forming at least a portion of the cooling system. The cooling system may also include at least one leading edge cooling chamber having at least one metering hole controlling the flow of cooling fluids into the cooling system substantially tangent to an inner wall forming a portion of the leading edge cooling chamber to form a vortex of cooling fluids in the leading edge cooling chamber. The cooling system may also include at least one trailing edge cooling chamber having at least one trailing edge supply orifice positioned to inject cooling fluids into the trailing edge cooling chamber to form a vortex in the trailing edge cooling chamber.

Positioned between the leading and trailing edge cooling chambers may be at least one suction side mid-chord cooling chamber positioned proximate to the suction side of the generally elongated blade. At least one suction side supply orifice may be positioned to inject cooling fluids into the suction side mid-chord cooling chamber and form a vortex in the suction side mid-chord cooling chamber. The suction side mid-chord cooling chambers may be linked together with bleed slots positioned in a staggered array, which forms multiple vortex suction side mid-chord cooling chambers coupled together in series.

The cooling system may also include at least one pressure side mid-chord cooling chamber positioned between the at least one leading edge cooling chamber and the at least one trailing edge cooling chamber and positioned proximate to the pressure side of the generally elongated blade. The pressure side mid-chord cooling chamber may also include at least one pressure side supply orifice positioned to inject cooling fluids into the pressure side mid-chord cooling chamber to form a vortex in the pressure side mid-chord cooling chamber. The pressure side mid-chord cooling chambers may be linked together with bleed slots positioned in a staggered array. The pressure side mid-chord cooling chambers may be linked together with bleed slots positioned in a staggered array, which forms multiple vortex pressure side mid-chord cooling chambers coupled together in series.

In one embodiment, one or more of the cooling chambers may include trip strips for increasing turbulence and heat transfer in the cooling chambers. The trip strips increase the internal heat transfer coefficient. The combined cooling effect realized by the combination of the trip strips and the vortex flow yields a high convection cooling efficiency for the turbine blade.

The cooling chambers may also include purge holes at the blade tip for discharging particles from the turbine blade. The vortices formed in the cooling chambers collect numerous particles along the longitudinal axis of the chambers as a result of the low velocity of cooling fluids found there. Rotation of the turbine blade about an axis creates forces that discharge the particles from the cooling chambers through the purge holes. Thus, the vortex flow of cooling fluids provides enhanced cooling capabilities and functions as a foreign object separator. Use of the purge holes enables the film cooling holes to be sized smaller without an increase in blockages and minimizes formation of blockages in internal bleed slots.

During operation, cooling fluids are passed through into the cooling cavities from cooling channels in the root of the turbine blade. The cooling fluids enter the leading edge cooling chambers through one or more metering holes and flow in close proximity with the inner surface forming the leading edge cooling chamber, whereby a vortex is formed as the fluids flow from the platform towards the tip around trip strips. This configuration cools the leading edge first, which generally has the highest heat load, before flowing to the mid-chord cooling chambers. As the cooling fluids flow towards the tip, some of the cooling fluids are exhausted through film cooling orifices and some of the cooling fluids flow through bleed slots into the suction side and pressure side mid-chord cooling chambers where the cooling fluids form vortices as well. The flow of cooling fluids into the suction side and pressure side mid-chord cooling chambers is determined based on the heat loads on the pressure and suction sides, which results in a generally uniform airfoil temperature distribution or a generally uniform thermal plane and reduces thermally induced strain.

As the cooling fluids flow rapidly along a spiral pathway in the cooling chambers, the contaminant particles collect along the longitudinal axis of the cooling chambers where the cooling flow velocity approaches zero. These contaminant particles are expelled from the turbine blade through the purge holes in the blade tip by forces generated by the vortices. The cooling fluids increase in temperature from heat received from the turbine blade as the cooling fluids flow through the cooling system. The cooling fluids then flow through the suction side and pressure side mid-chord cooling chambers and are exhausted from the chambers and the turbine blade through film cooling orifices.

The cooling fluids may also flow into the cooling system through a trailing edge cooling chamber proximate the mid-chord cooling chambers. The cooling fluids flowing into the trailing edge cooling chamber flow radially from the platform towards the tip. The cooling fluids are passed through the bleed slots between adjacent trailing edge cooling chambers. The cooling fluids form vortices in the trailing edge cooling chambers before being released from the turbine blade through orifices in the trailing edge.

An advantage of this invention is that the cooling chambers in the leading edge, the trailing edge, and mid-chord areas of the turbine blade are configured to create vortices of cooling fluids flowing through the cooling chambers. The vortices in these cooling chambers increase the velocity of the cooling fluids flowing in the cooling chambers and therefore, increase the heat transfer in the cooling chambers.

Another advantage of this invention is that the vortices that form in the cooling chambers cause contaminant particles to collect along the longitudinal axis of the cooling chambers and to be expelled from the turbine blade through purge holes in the tip.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
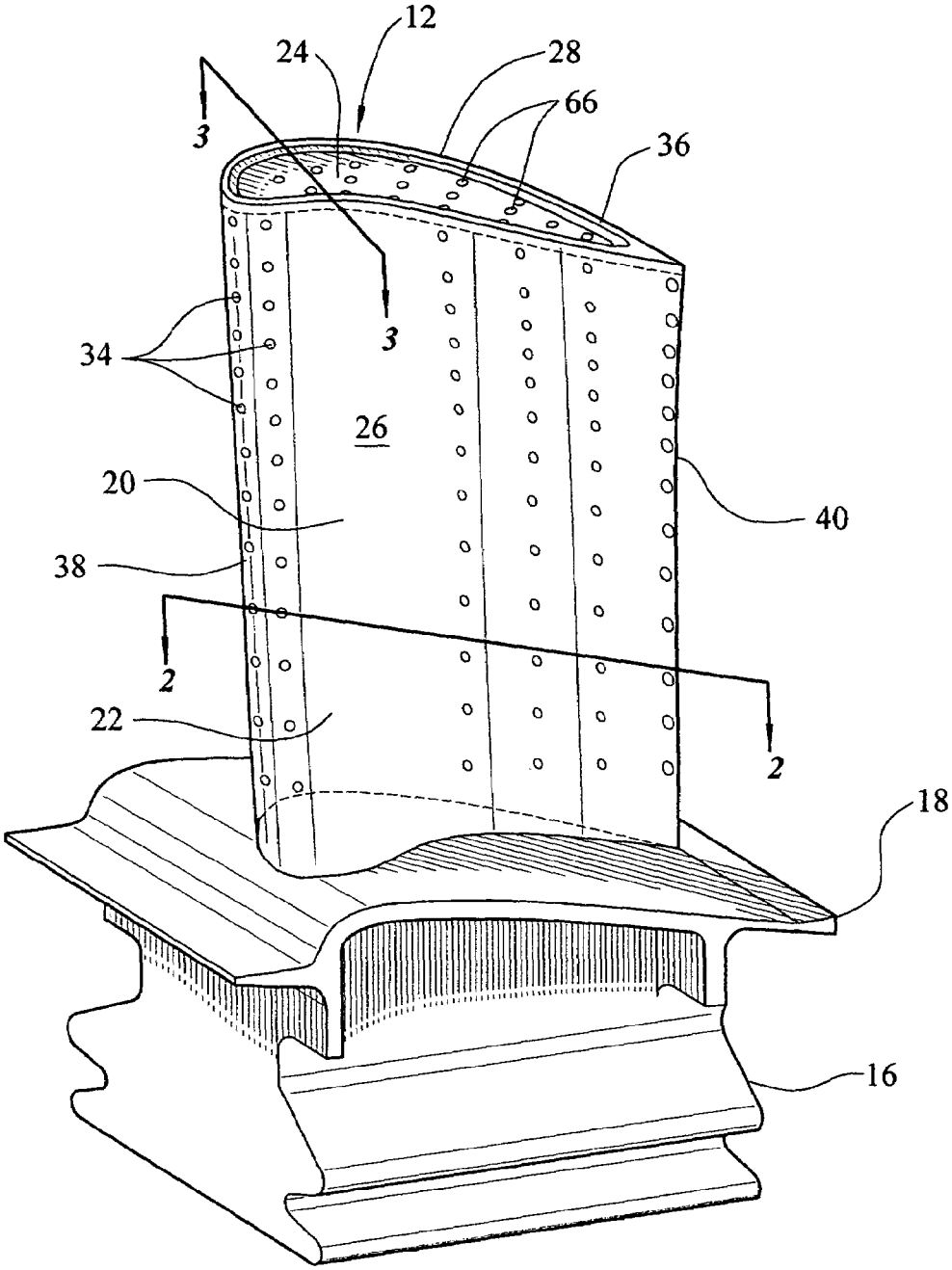
FIG. 1 is a perspective view of a turbine blade having aspects of this invention.
Figure 2:
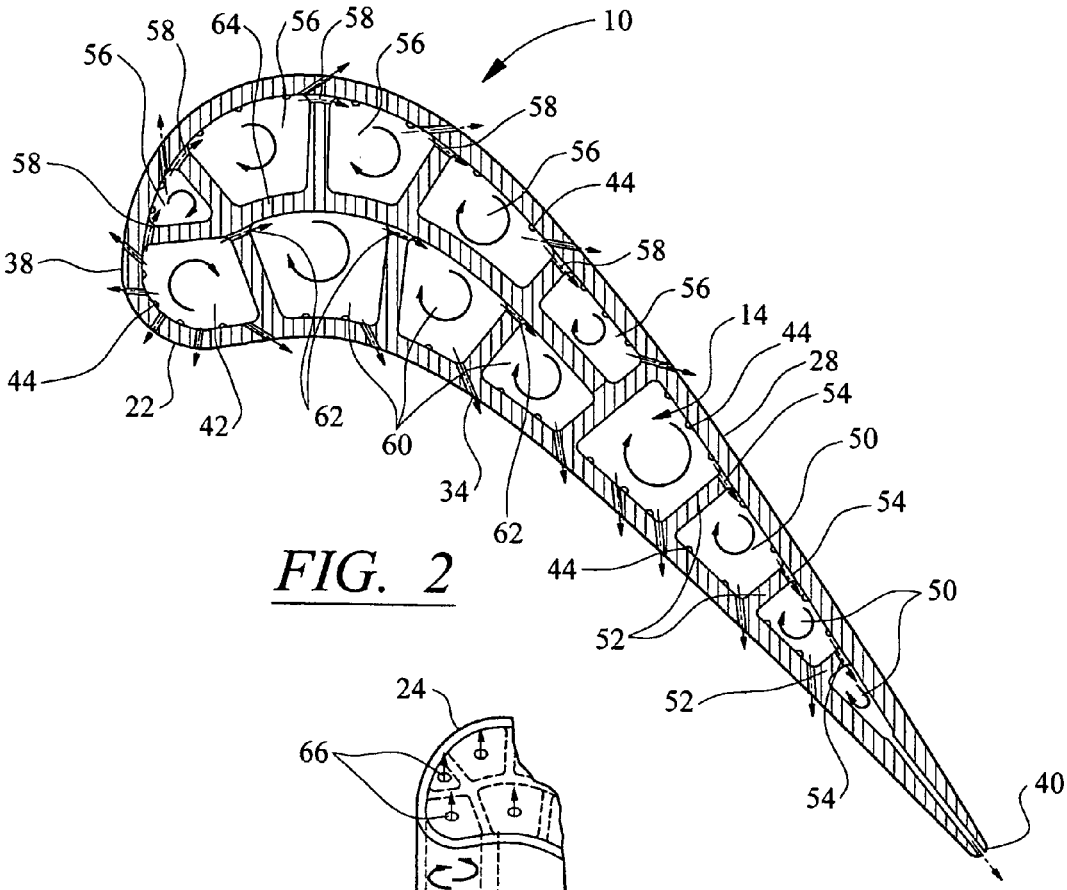
FIG. 2 is a cross-sectional view of the turbine blade shown in FIG. 1 taken along section line 2—2.
Figure 3:
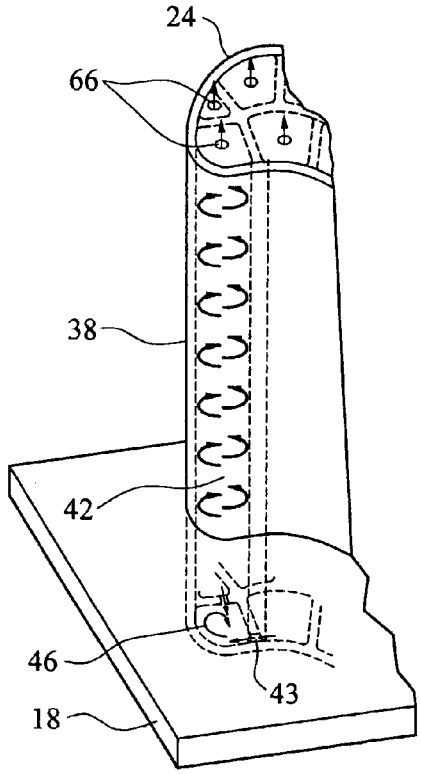
FIG. 3 is a partial perspective view of the turbine blade shown in FIG. 1 taken along section line 3—3.

This invention is directed to a turbine blade cooling system 10 for turbine blades 12 used in turbine engines. In particular, as shown in FIGS. 1–3, the turbine blade cooling system 10 is directed to a vortex cooling system located in a plurality of cooling cavities 14, as shown in FIG. 2, positioned between outer walls 22. The vortex cooling system 10 is composed of a plurality of cavities configured to create vortices of cooling fluids flowing through the cavities for increasing heat transfer between the turbine blade 12 and the cooling fluids flowing through cavities.

In at least one embodiment, as shown in FIGS. 1–2, the turbine blade 12 may be formed from a root 16 having a platform 18 and formed from a generally elongated blade 20 coupled to the root 16 at the platform 18. The turbine blade may also include a tip 36 generally opposite the root 16 and the platform 18. Blade 20 may have an outer wall 22 adapted for use, for example, in a first stage of an axial flow turbine engine or in other stages as well. Outer wall 22 may have a generally concave shaped portion forming pressure side 26 and may have a generally convex shaped portion forming suction side 28.

The cooling cavities 14, as shown in FIG. 2, may be positioned in inner aspects of the blade 20 for directing one or more cooling gases, which may include air received from a compressor (not shown), through the blade 20 and out one or more orifices 34, which may also be referred to as film cooling orifices, in the blade 20. As shown in FIG. 1, the orifices 34 may be positioned in a leading edge 38, a trailing edge 40, the pressure side 26, and the suction side 28 to provide film cooling. The orifices 34 provide a pathway from the cooling cavities 14 through the outer wall 22.

As shown in FIG. 2, the cooling system 10 may include one or more leading edge cooling chambers 42 for creating vortices of cooling fluids. The leading edge cooling chamber 42 extends radially along the leading edge 38 generally from the platform 18 to the blade tip 24. While in other embodiments, the leading edge cooling chamber 42 extends only along a portion of the leading edge 38 between the platform 18 and the tip 24. The leading edge cooling chamber 42 may receive cooling fluids from cooling cavities in the root 16. In particular, the cooling fluids may enter the leading edge cooling chamber 42 through one or more metering holes 43 positioned in a wall 46 separating the leading edge cooling chamber 42 from cooling channels in the root 16. The metering holes 43 may be positioned, as shown in FIG. 2, to direct cooling fluids into the leading edge cooling chamber 42 in a direction generally tangent to an inner wall forming the leading edge cooling chamber 42 so as to encourage formation of a vortex in the leading edge cooling chamber 42. In at least one embodiment, the leading edge cooling chamber 42 may be formed from two or more chambers whereby at least one chamber supplies cooling fluids to the mid-chord suction side cooling chambers 56 and at least one chamber supplies cooling fluids to the mid-chord pressure side cooling chambers 60.

The leading edge cooling chamber 42 may also include one or more trip strips 44 on inner surfaces of the leading edge cooling chamber 42 for increasing turbulence in the cooling fluids. The trip strips 44 may be positioned generally orthogonal to the flow of cooling fluids through the leading edge cooling chamber 42. The trip strip 44 is a protrusion extending from a surface a distance sufficient to create turbulence in the flow of cooling fluids as the cooling fluids pass of the trip strip 44. The trip strips 44 increase heat transfer through the cooling system 10.

The cooling system 10 may also include one or more trailing edge cooling chambers 50 in inner aspects of the trailing edge 40 for creating vortices of cooling fluids. The trailing edge cooling chamber 50 may extend radially generally along the trailing edge 40 of the blade 12. In some embodiments, the trailing edge cooling chamber 50 may extend radially from the platform 18 to the tip 24, while in other embodiments, the trailing edge cooling chamber 50 extends only along a portion of the trailing edge 40 between the platform 18 and the tip 24. The trailing edge cooling chamber 50 may also include a plurality of trip strips 44 positioned on the inner surfaces of the walls forming the trailing edge cooling chamber 50.

In at least one embodiment, the cooling system 10 is formed from a plurality of trailing edge cooling chambers 50, as shown in FIG. 2. In particular, there may be four trailing edge cooling chambers 50 positioned generally parallel to each other. However, the cooling system 10 is not limited to this number of trailing edge cooling chambers 50 but may include other numbers of trailing edge cooling chambers as well. The trailing edge cooling chambers 50 may be separated by ribs 52. Each trailing edge cooling chamber 50 may be in fluid communication with each other through a plurality of bleed slots 54 that enable cooling fluids to flow between adjacent trailing edge cooling chambers 50. The bleed slots 54 may be positioned so that cooling fluids flowing through the bleed slots 54 are exhausted in a trailing edge cooling chamber 50 generally tangent to an inner surface of the trailing edge cooling chamber 50. By exhausting cooling fluids in this manner, the cooling fluids can flow along the inner surface and create a generally circular fluid motion, such as a vortex, in the trailing edge cooling chambers 50. The bleed slots 54 may be positioned on the pressure side or the suction side of the turbine blade 12. In at least one embodiment, the bleed slots 54 in a trailing edge cooling chamber 50 may be offset radially relative to bleed slots 54 in an adjacent trailing edge cooling chamber 50. The trailing edge cooling chamber 50 may also include a trailing edge supply orifice positioned similarly to the metering holes 43 of the leading edge cooling chamber 42. The size of the trailing edge cooling chambers 50 may vary and may be determined based on the external heat load and pressure profile present in each trailing edge cooling chamber 50.

The cooling system 10 may also include one or more suction side mid-chord cooling chambers 56 positioned proximate to the portion of the outer wall 22 forming the suction side 28 for creating high cooling fluid velocities and high internal heat transfer while yielding a high overall cooling effectiveness. The suction side mid-chord cooling chambers 56 receive cooling fluids from the leading edge cooling chambers 42 through bleeds slots 58 positioned proximate to an inner surface of the outer wall 22. The cooling fluids are released into the suction side mid-chord cooling chambers 56 and form a vortex therein. In another embodiment, the bleed slots 58 may be positioned proximate to the inner rib 64. The bleed slots 58 may be sized based on the turbine blade 12 external heat load and pressure profiles on the suction side 28 of the turbine blade 12. In at least one embodiment, the cooling system 10 includes five suction side mid-chord cooling chambers 56. However, the cooling system 10 is not limited to this number of suction side mid-chord cooling chambers 56 but may include other numbers of suction side mid-chord cooling chambers 56 as well. The cooling fluids may be exhausted from the suction side mid-chord cooling chambers 56 through film cooling orifices 34. The suction side mid-chord cooling chambers 56 may also include a plurality of trip strips 44 on the inner surfaces forming the suction side mid-chord cooling chambers 56 for increasing turbulence and heat transfer.

The cooling system 10 may also include one or more pressure side mid-chord cooling chambers 60 along the pressure side 26 in the same general proximity in the chordwise direction of the turbine blade 12 as the suction side mid-chord cooling chambers 56. The pressure side mid-chord cooling chambers 60 receive cooling fluids from the leading edge cooling chambers 42 through bleeds slots 62 positioned proximate to an inner surface of the inner rib 64. In another embodiment, the bleed slots 62 may be positioned proximate to the outer wall 22. The inner rib 64 withstands cracking typical within conventional turbine engines that results because of an extreme pressure gradient between outer surfaces and the rib 64, because the vortices formed in the pressure side and suction side mid-chord cooling chambers heats the inner rib 64 and thereby decreases the pressure gradient between the inner rib 64 and outer surfaces of the turbine blade 12. The cooling fluids are released into the pressure side mid-chord cooling chambers 60 and form a vortex therein. The bleed slots 62 may be sized based on the turbine blade 12 external heat load and pressure profiles on the pressure side 26 of the turbine blade 12. In at least one embodiment, the cooling system 10 includes three pressure side mid-chord cooling chambers 60. However, the cooling system 10 is not limited to this number of pressure side mid-chord cooling chambers 60 but may include other numbers of pressure side mid-chord cooling chambers 60 as well. The cooling fluids are exhausted from the pressure side mid-chord cooling chambers 60 through film cooling orifices 34. The pressure side mid-chord cooling chambers 60 may also include a plurality of trip strips 44 on the inner surfaces forming the pressure side mid-chord cooling chambers 60 for increasing turbulence and heat transfer.

The cooling system 10 may also include a plurality of purge holes 66 in the tip 24 of the turbine blade 12 for exhausting particles from the cooling cavities 14, such as the leading edge and trailing edge cooling chambers 42, 50 and the mid-chord cooling chambers 56, 60. The purge holes 66 may be positioned generally along longitudinal axes of the cooling chambers 42, 50, 56, 60 such that during operation, the particles accumulate along these axes and travel to the tip 24 where the particles are discharged from the turbine blade 12. The purge holes 66 may be sized based on the anticipated particles needed to be discharged and the pressure differentials associated with the cooling chambers.

During operation, cooling fluids, such as, but not limited to air, are passed into the cooling cavities 14 from cooling channels in the root 16 of the turbine blade 12. The cooling fluids increase in temperature from heat received from the turbine blade as the cooling fluids flow through the cooling system 10. The cooling fluids enter the leading edge cooling chambers 42 through one or more metering holes 43. The cooling fluids flow in close proximity with the inner surface forming the leading edge cooling chamber 42 and create a vortex as the fluids flow from the platform 18 towards the tip 24 around trip strips 44. The vortices created in each of the cooling chambers 42, 50, 56, and 60 flow generally clockwise. As the cooling fluids flow towards the tip 24, some of the cooling fluids are exhausted through film cooling orifices 34 and some of the cooling fluids flow through bleed slots 58, 62 into the suction side and pressure side mid-chord cooling chambers 56, 60 where the cooling fluids form vortices as well. As the cooling fluids flow rapidly in a spiral manner in the cooling chambers 42, the contaminant particles collect along the longitudinal axis of the cooling chambers 42 where the cooling flow velocity is very low, if not zero. These contaminant particles are expelled from the turbine blade 12 through the purge holes 66 in the tip 24 due to the forces created by the turbine blade 12 being rotated in a turbine engine about an axis. The cooling fluids then flow through the suction side and pressure side mid-chord cooling chambers 56, 60 where the cooling fluids increase in temperature and are exhausted from the chambers 56, 60 and the turbine blade 12 through film cooling orifices 34.

The cooling fluids may also flow into the cooling system 10 through a trailing edge cooling chamber 50 proximate the mid-chord cooling chambers 56, 60. The cooling fluids flowing into the trailing edge cooling chamber 50 flow radially from the platform 18 towards the tip 24. The cooling fluids are passed through the bleed slots 54 between adjacent trailing edge cooling chambers 50. The cooling fluids form vortices in the trailing edge cooling chambers 50 before being released from the turbine blade 12 through orifices in the trailing edge 40.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade having a leading edge, a trailing edge, and a tip at a first end, a root coupled to the blade at a platform generally opposite the first end for supporting the blade and for coupling the blade to a disc, at least one cavity forming a cooling system in the blade, and at least one outer wall defining the at least one cavity forming at least a portion of the cooling system;

wherein the cooling system comprises at least one leading edge cooling chamber having at least one metering hole controlling the flow of cooling fluids into the leading edge cooling chamber generally tangent to an inner surface forming a portion of the leading edge cooling chamber;

at least one trailing edge cooling chamber having at least one trailing edge supply orifice positioned to pass cooling fluids into the trailing edge cooling chamber to form a vortex in the trailing edge cooling chamber;

at least one suction side mid-chord cooling chamber positioned between the at least one leading edge cooling chamber and the at least one trailing edge cooling chamber, positioned proximate to a suction side of the generally elongated blade, and including at least one bleed slot positioned to pass cooling fluids into the suction side mid-chord cooling chamber to form a vortex in the suction side mid-chord cooling chamber; and at least one pressure side mid-chord cooling chamber positioned between the at least one leading edge cooling chamber and the at least one trailing edge cooling chamber, positioned proximate to the pressure side of the generally elongated blade, and including at least one bleed slot positioned to pass cooling fluids into the pressure side mid-chord cooling chamber to form a vortex in the pressure side mid-chord cooling chamber.

2. The turbine blade of claim 1, further comprising a plurality of trip strips positioned on inner wall surfaces forming the at least one leading edge cooling chamber.

3. The turbine blade of claim 1, further comprising a plurality of trip strips positioned on inner wall surfaces forming the at least one trailing edge cooling chamber.

4. The turbine blade of claim 1, further comprising a plurality of trip strips positioned on inner wall surfaces forming the at least one suction side mid-chord cooling chamber.

5. The turbine blade of claim 1, further comprising a plurality of trip strips positioned on inner wall surfaces forming the at least one pressure side mid-chord cooling chamber.

6. The turbine blade of claim 1, wherein the at least one trailing edge cooling chamber comprises four trailing edge cooling chambers and three ribs extending radially along the trailing edge of the generally elongated blade, wherein the three ribs include bleed slots configured to emit cooling fluids tangent to an inner surface for a trailing edge cooling chamber.

7. The turbine blade of claim 6, wherein the bleed slots between adjacent ribs are offset radially.

8. The turbine blade of claim 1, wherein the at least one suction side mid-chord cooling chamber comprises at least five suction side mid-chord cooling chambers extending radially in the elongated blade proximate to the suction side of the blade and including bleed slots in ribs separating the suction side mid-chord cooling chambers and located proximate to an inner surface of the outer wall such that cooling fluids flowing through the bleed slots exit generally tangent to a surface forming the suction side mid-chord cooling chamber to form a vortex.

9. The turbine blade of claim 1, wherein the at least one pressure side mid-chord cooling chamber comprises at least three pressure side mid-chord cooling chambers extending radially in the elongated blade proximate to the pressure side of the blade and including bleed slots in ribs separating the pressure side mid-chord cooling chambers and located proximate to an inner surface of the outer wall such that cooling fluids flowing through the bleed slots exit generally tangent to a surface forming the pressure side mid-chord cooling chamber to form a vortex.

10. The turbine blade of claim 1, wherein the ax least one metering hole in communication with the at least one leading edge cooling chamber comprises two metering holes providing a fluid pathway between the cooling system and the leading edge cooling chamber for supplying cooling fluids to the leading edge cooling chamber and for passing cooling fluids substantially tangent to an inner surface of the leading edge cooling chamber to form a vortex.

11. The turbine blade of claim 1, further comprising a plurality of purge holes in the tip of the turbine blade, wherein each purge hole is positioned generally along a longitudinal axis of a cooling chamber into which the purge hole provides a fluid pathway.

12. The turbine blade of claim 1, further comprising a plurality of film cooling holes in the outer wall providing a cooling fluid pathway between the cooling system and an outer surface of the outer wall.

13. A turbine blade, comprising:

a generally elongated blade having a leading edge, a trailing edge, and a tip at a first end, a root coupled to the blade at a platform generally opposite the first end for supporting the blade and for coupling the blade to a disc, at least one cavity forming a cooling system in the blade, and at least one outer wall defining the at least one cavity forming at least a portion of the cooling system;

wherein the cooling system comprises at least one leading edge cooling chamber having at least two metering holes controlling the flow of cooling fluids into the cooling system generally tangent to an inner surface forming a portion of the leading edge cooling chamber;

at least four trailing edge cooling chambers separated by three ribs and having trailing edge bleed slots positioned in each rib to pass cooling fluids into the trailing edge cooling chambers to form vortices in the trailing edge cooling chambers;

at least five suction side mid-chord cooling chambers positioned between the leading edge cooling chambers and the trailing edge cooling chambers, positioned proximate to the suction side of the generally elongated blade, and including suction side supply orifices positioned to pass cooling fluids into the suction side mid-chord cooling chambers to form vortices in the suction side mid-chord cooling chambers;

at least three pressure side mid-chord cooling chambers positioned between the at least one leading edge cooling chamber and the trailing edge cooling chambers, positioned proximate to the suction side of the generally elongated blade, and including pressure side bleed slots positioned to pass cooling fluids into the suction side mid-chord cooling chambers to form a vortices in the suction side mid-chord cooling chambers;

a plurality of purge holes in the tip of the turbine blade, wherein each purge hole is positioned generally along a longitudinal axis of a cooling chamber into which the purge hole provides a fluid pathway; and a plurality of film cooling holes in the outer wall providing a cooling fluid pathway between the cooling system and an outer surface of the outer wall.

14. The turbine blade of claim 13, further comprising a plurality of trip strips positioned on inner wall surfaces forming the at least one leading edge cooling chamber, the trailing edge cooling chambers, the suction side mid-chord cooling chambers, and the pressure side mid-chord cooling chambers.

15. The turbine blade of claim 13, wherein the trailing edge bleed slots between adjacent ribs are offset radially.

* * * * *